US010550597B2

(12) United States Patent
Her

(10) Patent No.: US 10,550,597 B2
(45) Date of Patent: Feb. 4, 2020

(54) SUICIDE-PREVENTING FENCE

(71) Applicant: ALUMIZONE CO., LTD, Incheon (KR)

(72) Inventor: Song Woo Her, Incheon (KR)

( * ) Notice: Subject to any disclaimer, the term of this patent is extended or adjusted under 35 U.S.C. 154(b) by 129 days.

(21) Appl. No.: 15/533,672

(22) PCT Filed: Oct. 11, 2015

(86) PCT No.: PCT/KR2015/010697
§ 371 (c)(1),
(2) Date: Jun. 7, 2017

(87) PCT Pub. No.: WO2016/093480
PCT Pub. Date: Jun. 16, 2016

(65) Prior Publication Data

US 2017/0321447 A1 Nov. 9, 2017

(30) Foreign Application Priority Data

Dec. 9, 2014 (KR) ..... 10-2014-0175711

(51) Int. Cl.
*E04H 17/00* (2006.01)
*E01D 19/10* (2006.01)
(Continued)

(52) U.S. Cl.
CPC ..... *E04H 17/003* (2013.01); *E01D 19/10* (2013.01); *G08B 21/02* (2013.01); *G08B 21/18* (2013.01)

(58) Field of Classification Search
CPC ..... E04H 17/003; E01D 19/10; E01D 19/103
(Continued)

(56) References Cited

U.S. PATENT DOCUMENTS 4,739,970 A * 4/1988 Francis ..... E04H 17/003 256/1
6,571,517 B2 * 6/2003 Wulff ..... A01G 13/10 119/514
(Continued)

FOREIGN PATENT DOCUMENTS

FR 2879642 A1 * 6/2006 ..... E04H 17/00
GB 2502042 A * 11/2013 ..... E04H 17/003
(Continued)

OTHER PUBLICATIONS

International Search Report ISA/KR dated Jan. 14, 2016.

*Primary Examiner* — Matthieu F Setliff
(74) *Attorney, Agent, or Firm* — Patshegen IP LLC; Moshe Pinchas

(57) ABSTRACT

A suicide preventing fence including: a plurality of pole parts provided standing upright from the ground surface at predetermined intervals, and a plurality of linking parts which are formed in the shape of pipes and horizontally link the spaces between the pole parts. The fence further includes rotating bodies which are formed with an internally hollow abacus bead shape and are provided on the outer circumferential surfaces of the linking parts, and bearings which are provided on the outer circumferential surfaces of the linking parts, positioned in the centers on the insides of the rotating bodies. The fence further includes rotating bolts which are provided on the outer circumferential surfaces of the linking parts and are inserted in through passing regions on both side surfaces of the rotating bodies so as to rotate together with the rotating bodies.

3 Claims, 4 Drawing Sheets

(51) Int. Cl.
*G08B 21/02* (2006.01)
*G08B 21/18* (2006.01)

(58) Field of Classification Search
USPC ..... 256/12, 16
See application file for complete search history.

(56) References Cited

U.S. PATENT DOCUMENTS

| | | | | |
|---|---|---|---|---|
| 6,585,233 | B1 * | 7/2003 | Sorben | A01K 3/00 256/1 |
| 2013/0062584 | A1 * | 3/2013 | Edmondson | E04H 17/003 256/2 |

FOREIGN PATENT DOCUMENTS

| | | | |
|---|---|---|---|
| JP | 2003-021045 | A | 1/2003 |
| KR | 10-2004-0095588 | A | 11/2004 |
| KR | 10-0584667 | B1 | 5/2006 |
| KR | 10-2011-0101634 | A | 9/2011 |
| KR | 10-1278223 | B1 | 6/2013 |

* cited by examiner

SUICIDE-PREVENTING FENCE

CROSS-REFERENCE TO RELATED PATENT APPLICATION

This application claims the benefit of Korean Patent Application No. 10-2014-0175711, filed on Dec. 9, 2014, in the Korean Intellectual Property Office, the disclosure of which is incorporated herein in its entirety by reference.

TECHNICAL FIELD

The present invention relates to a suicide-preventing fence, and more specifically, to a technology for preventing a person who attempts to commit suicide from passing over a fence by installing a suicide-preventing fence on a bridge rail.

BACKGROUND ART

Currently, threatening to commit suicide at a bridge is not merely considered as a sort of happening, but is becoming a social problem, and it is in urgent need to take measures to prevent suicide attempt and threat. The suicide attempt and threat at a bridge is not only a personal matter but also a waste of manpower due to input of personnel from private and public organizations to prevent the suicide attempt and threat, and causes various discomforts of citizens, such as traffic congestion, and a social problem such as a national image being tarnished.

As one of related arts, Korean Patent No. 10-1150457 relates to railing for preventing a separation of a bridge and discloses a technology wherein a movement in a lateral direction of a first bridge deck or a second bridge deck is detected through configurations of first and second fence assemblies, a linking bar, a separation detection sensor, a controller, a light bar, and a transmitter and the movement is quickly informed to a driver who is passing through the bridge, and at the same time, is notified to a manager who resides in a bridge management office, thereby preventing fatal accidents due to the separation of the deck and allowing for monitoring the situation of the site and quickly responding to any possible accidents.

However, in the aforementioned related art, a cylindrical guide rail is configured to be rotatable, but there are drawbacks in that a person attempting suicide can grip the guide rail with hands and can even more easily pass over the bridge rail using the guide rail rotating.

Therefore, there is a need for a technology that can prevent a person attempting suicide from gripping the fence, thereby breaking the will to attempt suicide in advance.

DISCLOSURE

Technical Problem

The technical solution to solve the technical problem of the present invention is to provide a suicide-preventing fence in which rotating bodies are provided, thereby making it difficult for a person who attempts to pass over the fence to grasp the fence; rotating ropes are wound around the rotating bodies to rotate so that the rotating ropes cannot be pulled out even when pulled; an alarm signal is generated when a load of the person attempting to pass over the fence; and electric energy is produced by the wind.

Technical Solution

One aspect of the present invention provides a suicide-preventing fence including: a plurality of pole parts provided standing upright from the ground surface at predetermined intervals; a plurality of linking parts which are formed in the shape of pipes and horizontally link the spaces between the pole parts; and a plurality of rotating parts, each of which comprises a rotating body which is formed with an internally hollow abacus bead shape and is provided on an outer circumferential surface of the linking part, a bearing which is provided on the outer circumferential surface of the linking part, positioned in the center on an inside of the rotating body; and rotating bolts which are provided on the outer circumferential surface of the linking part and are inserted in through-passing regions on both side surfaces of the rotating body so as to rotate together with the rotating body.

Each of the rotating bolts may have one side inserted into the through-passing region of the rotating body and the other side formed with saw teeth, and a plurality of rotating bodies provided on the liking parts may rotate by tooth-engagement between the rotating bolts.

A fitting groove may be formed in the center of the rotating body along the outer circumferential surface and the suicide-preventing fence may further include rotating ropes, each of which is connected to the fitting grooves of vertically arranged rotating bodies among the plurality of rotating bodies provided on different linking parts.

The suicide-preventing fence may further include rotating blades provided at predetermined intervals along the outer circumferential surfaces of the rotating bodies, and power generating parts configured to generate electricity as the rotating blades rotate.

The suicide-preventing fence may further include alarm parts provided on both ends of each of the linking parts and configured to generate an alarm signal when the linking parts are pressurized.

Advantageous Effects

Accordingly, the rotating bodies are provided on the fence, and hence it is possible to prevent suicide by making it difficult for a person attempting to pass over the fence to grasp the fence. In addition, the rotating ropes are wound around the rotating bodies so that the rotating ropes are not pulled out even when pulled, and thereby it is possible to prevent suicide. In addition, it is possible to warn when suicide attempt is made by detecting a load of the person attempting to pass over the fence and generating an alarm signal. Further, it is possible to generate electric energy by the wind.

MODES OF THE INVENTION

Hereinafter, exemplary embodiments of the present invention will now be described fully with reference to the accompanying drawings. Terms described below are selected by considering functions according to exemplary embodiments, and may vary depending on a user or operator's intention, or precedents and so on. Therefore, in the following embodiments, when terms are specifically defined, the meanings of terms should be interpreted based on definitions, and otherwise, should be interpreted based on general meanings recognized by those skilled in the art.

Figure 1:
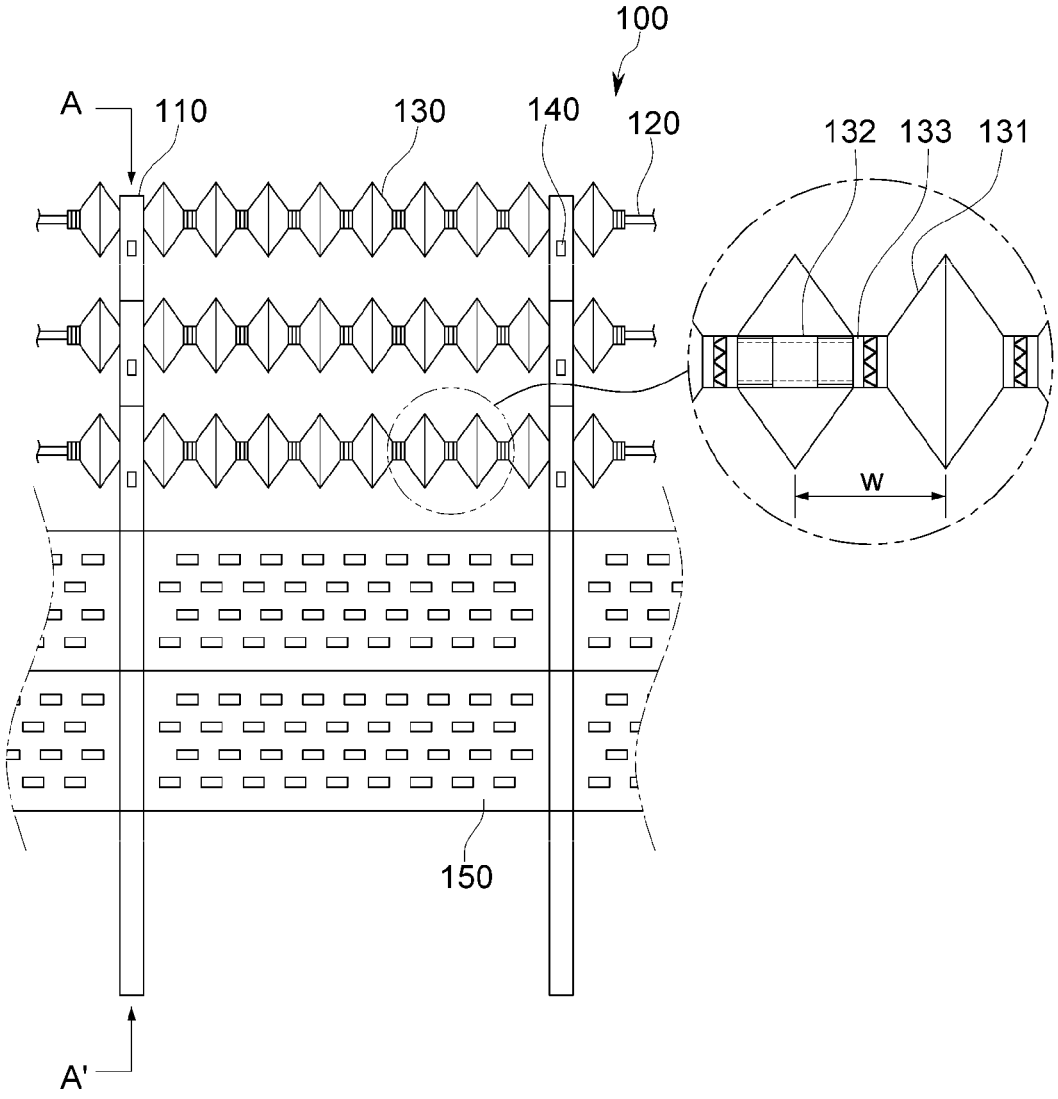
FIG. 1 is a configuration diagram of a suicide-preventing fence according to one embodiment of the present invention.
Figure 2:
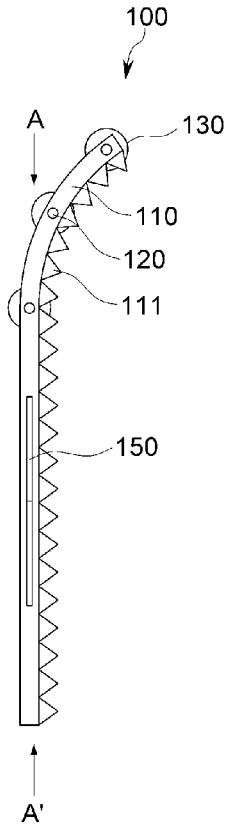
FIG. 2 is a cross-sectional view of the suicide-preventing fence taken along line A-A' of FIG. 1.

FIG. 1 is a configuration diagram of a suicide-preventing fence according to one embodiment of the present invention, and FIG. 2 is a cross-sectional view of the suicide-preventing fence taken along line A-A' of FIG. 1.

Referring to FIGS. 1 and 2, the suicide-preventing fence 100 according to one embodiment of the present invention includes pole parts 110, linking parts 120, and rotating parts 130.

A plurality of pole parts 110 are frames that support the suicide-preventing fence 100 from the ground surface. The plurality of pole parts 110 are fixedly installed to stand upright from the ground surface at predetermined intervals. A plurality of linking parts 120, which will be described later, are inserted and fixed to side surfaces of the plurality of pole parts 110. In addition, regions of the plurality of pole parts 110 which are buried in the ground may be supported by a support member (not shown) buried in the ground. The cross-section of the pole part 110 may be in the shape of an "H" or "T", but is not limited thereto.

In addition, the plurality of pole parts 110 may be formed in a linear shape or an upwardly curved shape. In the case of an upwardly curved shape, it is difficult for a person to pass over the fence by climbing the linking parts 120 connected to the pole parts 110. In this case, an anti-crime plate in the form of a triangle (Δ) may protrude from one surface of each pole part 110. This is to prevent a person from passing over the fence by grasping the pole part 110.

The linking parts 120 are formed in the shape of pipes and horizontally link the spaces between the pole parts 110. A plurality of linking parts 120 may be formed between the plurality of pole parts 110. The rotating parts 130 are provided on outer circumferential surfaces of the linking parts 120. In this case, the linking parts 120 are not exposed to the outside as the plurality of rotating parts 130 are fitted to the outer circumferential surfaces of the linking parts. The linking parts 120 are coupled to the rotating parts 130 by bearings 132. The linking parts 120 serve as the center of a rotation such that the rotating parts 130 can rotate along the outer circumferential surfaces of the linking parts 120.

The rotating parts 130 are provided on the outer circumferential surfaces of the linking parts 120 and rotate along the outer circumferential surfaces of the linking parts 120. The rotating parts 130 are configured to make it difficult for a person attempting to pass over the suicide-preventing fence 100 to grasp the same. When a person grasps the plurality of rotating parts 130 and attempts to pass over the fence, the rotating parts 130 rotates to make the person to give up on passing over the fence. In this case, the center portion of each rotating part 130 is formed to protrude and center intervals W between the plurality of rotating parts 130 may be set such that an average human hand cannot enter. For example, the center interval W may be preferably between 1 cm and 10 cm, but is not limited thereto. Hereinafter, the rotating parts 130 will be described in detail with reference to FIG. 3.

Figure 3:
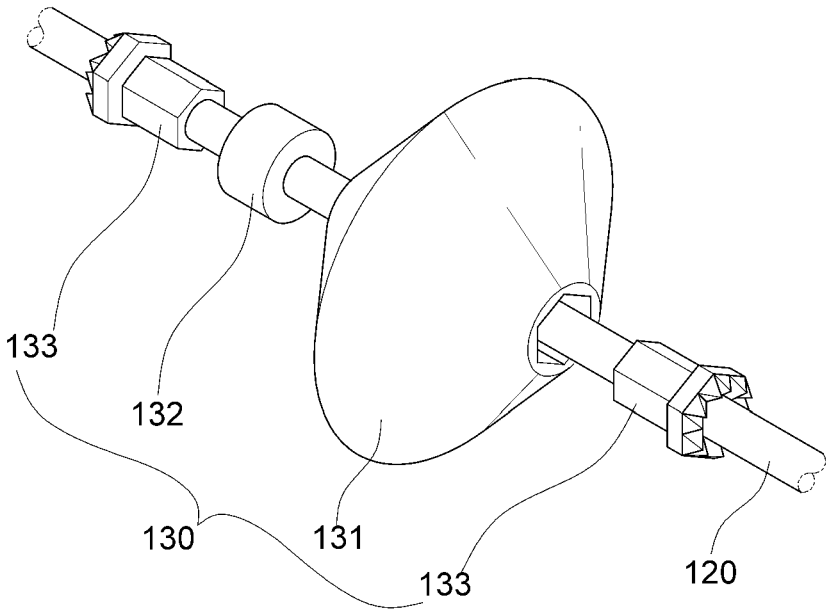
FIG. 3 is an exploded perspective view of the rotating part of the suicide-preventing fence of FIG. 1.

FIG. 3 is an exploded perspective view of the rotating part of the suicide-preventing fence of FIG. 1.

Referring to FIG. 3, more specifically, the rotating part 130 includes a rotating body 131, a bearing 132, and rotating bolts 133. The rotating body 131 is formed with an internally hollow abacus bead shape and is provided on the outer circumferential surface of the linking part 120. The bearing 132, which will be described later, is positioned in the hollow interior of the rotating body 131 and each of the rotating bolts 133, which will be described later, is inserted into each hollow opening on both side surfaces of the rotating body 131. The width of the rotating body 131 may be adjusted by the user's setting to make it difficult for a user to grip the rotating body 131 with hands. The outer diameter of the center portion is formed to be larger than the outer diameter of both side portions through the rotating body 131.

The bearing 132 is positioned in the center on the inside of the hollow region of the rotating body 131 and is provided on the outer circumferential surface of the linking part 120. In this case, the rotating body 131 may be divided at the center to position the bearing 132 therein, and then the bearing 132 is fixed by engaging the rotating body 131. The bearing 132 may allow the rotating body 131 to rotate along the outer circumferential surface of the linking part 120. In the case where the bearing 132 is located in the center on the inside of the rotating body 131, the rotating bolts 133, which will be described later, close both sides of the rotating body 131, thereby fixing the bearing 132 inside.

The rotating bolts 133 are provided on the outer circumferential surface of the linking part 120 and are inserted into the through-passing regions at both side surfaces of the rotating body 131 so as to rotate together with the rotating body 131. For example, in the case where a cross-section of the hollow region is hexagonal, one side of each rotating bolt 133 may be formed in a hexagonal shape. Serrated protrusions are formed on the other side of each rotating bolt 133. The plurality of rotating bodies 131 provided on the linking part 120 rotate by tooth-engagement between the rotating bolts 133. When one of the rotating bodies 131 rotates, all rotating bodies 131 provided on the corresponding linking part 120 rotate as the teeth of the rotating bolts 133 are engaged with each other.

Referring back to FIG. 1, the suicide-preventing fence 100 may further include alarm parts 140. The alarm parts 140 are provided on both ends of the linking part 120, and generate an alarm signal when the linking part 120 is pressurized. When the linking part 120 is pressurized, the alarm part 140 may sense a load and generates an alarm signal to indicate the presence of a person attempting to pass over the fence. Hereinafter, the alarm part 140 will be described in detail with reference to FIG. 4.

Figure 4:
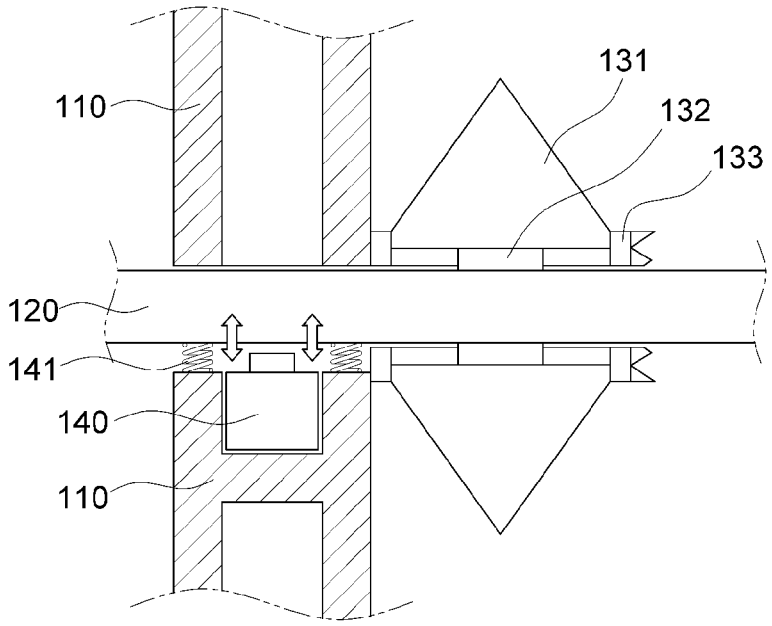
FIG. 4 is an exemplary diagram for describing the alarm part of the suicide-preventing fence of FIG. 1.

FIG. 4 is an exemplary diagram for describing the alarm part of the suicide-preventing fence of FIG. 1.

Referring to FIG. 4, the alarm part 140 is positioned below the linking part 120 and is embedded into the pole part 110. In this case, the linking part 120 is supported and positioned between the pole parts 110 by springs 141. When an external force is not exerted on the linking part 120, both sides of the linking part 120 are inserted into the pole part 110 so that the linking part 120 is positioned to be spaced apart from the alarm part 140 by the spring 141 provided on the pole part 110. When an external force is exerted on the linking part 120, the linking part 120 is pressurized downward and the spring 141 is compressed and brought into contact with the alarm part 140. In this case, the spring may be preferably designed to support a predetermined load. The alarm part 140 may be formed as a piezoelectric device and generate an electrical signal from the exerted load so as to allow the alarm signal to be output from a speaker (not shown) or a light bar (not shown) provided on the suicide-preventing fence 100. In addition, it may be possible to transmit the alarm signal to an external management server (not shown) through a communication part (not shown) provided on the suicide-preventing fence 100.

Referring back to FIG. 1, the suicide-preventing fence 100 according to an embodiment of the present invention may further include a perforated plate 150. The perforated plate 150 is provided between the plurality of pole parts 110 and is a plate on which a plurality of holes are formed. The linking part 120 may be provided on the upper portions of the plurality of pole parts 110 and the perforated plate 150 may be provided on the lower portions of the plurality of pole parts 110. This is to prevent a person from stepping on the linking part 120 and leaping therefrom, and the perforated plate 150 may be installed up to a specific height.

Figure 5:
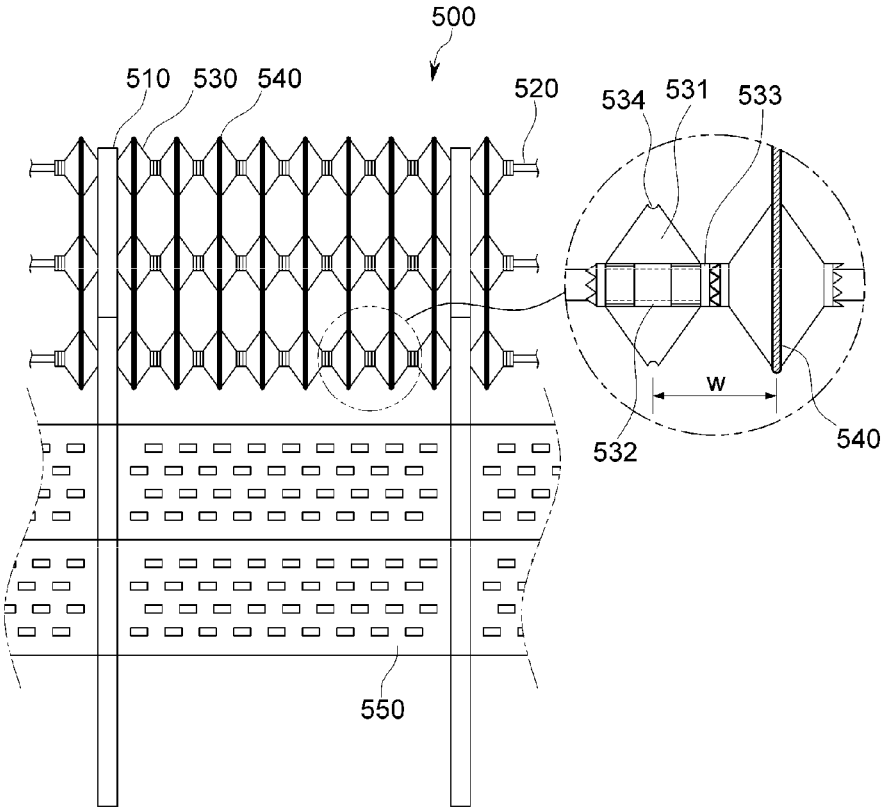
FIG. 5 is a configuration diagram of a suicide-preventing fence according to another embodiment of the present invention.

FIG. 5 is a configuration diagram of a suicide-preventing fence according to another embodiment of the present invention.

Referring to FIG. 5, the suicide-preventing fence 500 according to another embodiment of the present invention includes pole parts 510, linking parts 520, rotating parts 530, and rotating ropes 540. In this case, configurations of the pole parts 510, the linking parts 520, and the rotating parts 530 are substantially the same as those of the pole parts 110, the linking parts 120, and the rotating parts 130, and hence redundant descriptions will be omitted.

Each rotating part 530 includes a rotating body 531, a bearing 532 and rotating bolts 533, and a fitting groove 534 is formed in the center of the rotating body 531 along an outer circumferential surface. The fitting groove 534 is a "U"-shaped groove in which the rotating rope 540, which will be described later, is accommodated. The rotating body 531 of the rotating part 530 may rotate by the bearing 532 and the rotating bolts 533 or may rotate according to the rotation of the rotating rope 540. The rotating parts 530 may be each provided on each of the linking parts 520 between the plurality of pole parts 510, and in this case, it may be possible to install the fitting grooves 534 on the uppermost rotating part 530 and the lowermost rotating part 530.

The rotating rope 540 is a linking member inserted into the U-shaped fitting groove 534 provided on the rotating body 531 of the rotating part 530. For example, the rotating rope 540 may be connected to the fitting grooves 534 of the vertically arranged rotating bodies 531 among the plurality of rotating bodies 531 provided on different linking parts 520. In this case, the rotating rope 540 may be inserted into the outer circumferential surfaces of the uppermost rotating body 531 and the lowermost rotating body 531 so as to serve as a chain. Thus, when the user pulls the rotating rope 540 downward, the user rotates and slides together with the rotating bodies 531, thereby preventing the user from passing over the suicide-preventing fence 500.

Meanwhile, the suicide-preventing fence 500 according to the embodiment of the present invention may further include a perforated plate 550. The perforated plate 550 is provided between the plurality of pole parts 510 and is a plate on which a plurality of holes are formed. The configuration of the perforated plate 550 is substantially the same as that of the perforated plate 150 described in FIG. 1, and hence a detailed description thereof will be omitted.

In addition, it should be apparent to those skilled in the art that the suicide-preventing fence 500 may further include the alarm part 140 described in FIG. 1.

Figure 6:
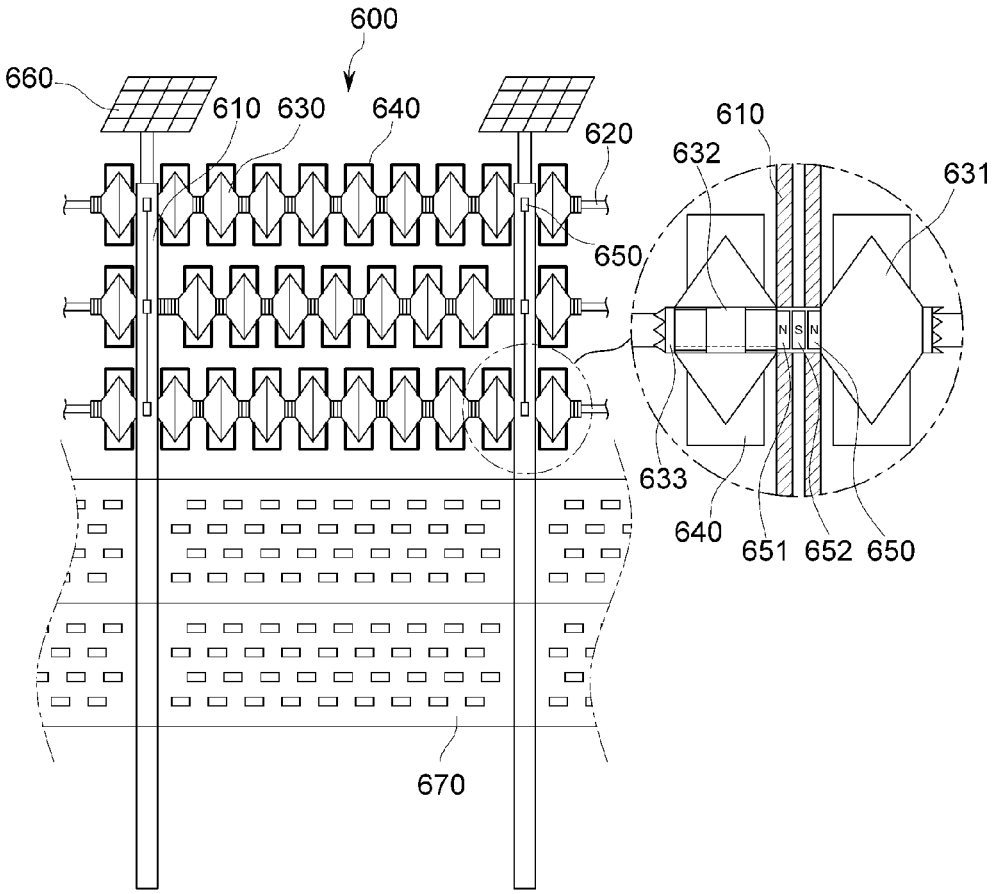
FIG. 6 is a configuration diagram of a suicide-preventing fence according to still another embodiment of the present invention.
Figure 7:
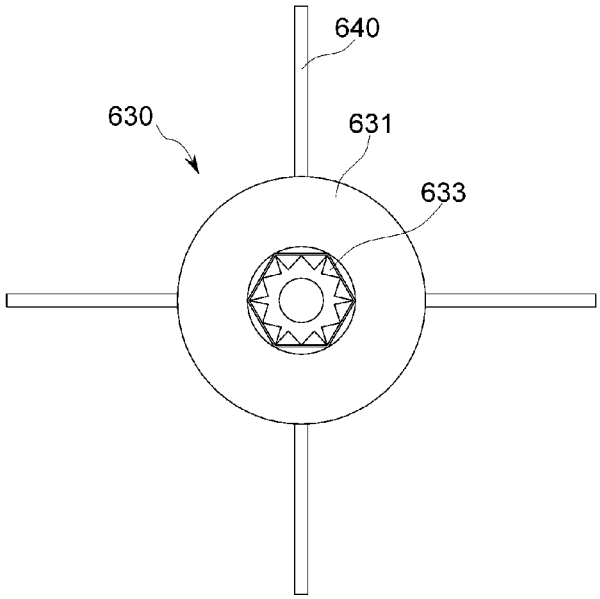
FIG. 7 is a cross-sectional view of a rotating part of the suicide-preventing fence of FIG. 6.

FIG. 6 is a configuration diagram of a suicide-preventing fence according to still another embodiment of the present invention, and FIG. 7 is a cross-sectional view of a rotating part of the suicide-preventing fence of FIG. 6.

Referring to FIGS. 6 and 7, the suicide-preventing fence 600 according to still another embodiment of the present invention includes pole parts 610, linking parts 620, rotating parts 630, rotating blades 640, and power generating parts 650. In this case, configurations of the pole parts 610, the linking parts 620, and the rotating parts 630 are substantially the same as those of the pole parts 110, the linking parts 120, and the rotating parts 130, and hence redundant descriptions will be omitted.

The rotating blades 640 are plate-shaped members provided at predetermined intervals along an outer circumferential surface of a rotating body 631 of each rotating part 630. In this case, the rotating blades 640 may be bent at a predetermined angle so as to be influenced by the wind. A plurality of rotating blades 640 may be formed along the outer circumferential surface of each rotating body 631. The rotating blades 640 may rotate in engagement with the rotating body 631, and may rotate by the wind or an external force. In this case, the rotating body 631 may rotate with friction minimized by the bearing 632 provided on the linking part 620. As the rotating blades 640 rotate by the wind, the rotating bolts 633 also rotate together and the power generating part 650 may generate electricity by converting the rotational energy into electric energy.

The power generating parts 650 generate electricity as the rotating blades 640 rotate. Specifically, the power generating parts 650 are provided inside the pole parts 610 and each of the power generating part 650 includes a first magnetic body 651 of a first polarity connected to the rotation bolt 633 and a second magnetic body 652 of a second polarity which is opposite to the first polarity. The first magnetic body 651 may be rotated by the rotating bolt 633 to induce a change in the magnetic field between the first magnetic body 651 and the fixed second magnetic body 652, thereby producing electricity. In this case, the produced electricity is stored in an internal battery (not shown) to supply power to a speaker (not shown), a light bar (not shown), a communication part (not shown), and the like.

Meanwhile, the suicide-preventing fence 600 according to the embodiment of the present invention may further include solar panels 660. The solar panel 660 is provided on top of the pole part 610 to convert solar energy into electric energy. The solar panel 660 may store the electric energy in an internal battery (not shown) to supply power to a speaker (not shown), a light bar (not shown), a communication part (not shown), and the like.

In addition, the suicide-preventing fence 600 according to the embodiment of the present invention may further include a perforated plate 670. The perforated plate 670 is provided between the plurality of pole parts 610 and is a plate on which a plurality of holes are formed. The configuration of the perforated plate 670 is substantially the same as that of the perforated plate 150 described in FIG. 1, and hence a detailed description thereof will be omitted.

Meanwhile, it should be apparent to those skilled in the art that the suicide-preventing fence 600 according to the embodiment of the present invention may further include the alarm part 140 described in FIG. 1.

Although the present invention has been described on the basis of the embodiments described with reference to the drawings, but it is not limited thereto. Therefore, the present invention should be construed on the basis of claims intended for including modifications that can be achieved apparently from the embodiments.

The invention claimed is:

1. A suicide-preventing fence comprising:

a plurality of pole parts provided standing upright from the ground surface at predetermined intervals;

a plurality of linking parts which are formed in the shape of pipes and horizontally link the spaces between the pole parts; and a plurality of rotating parts, each of which comprises a rotating body which is formed with an internally hollow abacus bead shape and is provided on an outer circumferential surface of the linking part, a bearing which is provided on the outer circumferential surface of the linking part, positioned in the center on an inside of the rotating body; and rotating bolts which are provided on the outer circumferential surface of the linking part and are inserted in through-passing regions on both side surfaces of the rotating body so as to rotate together with the rotating body; and alarm parts provided on both ends of each of the linking parts and positioned below the linking part and configured to generate an alarm signal when the linking parts are pressurized downward;

wherein each of the rotating bolts has one side inserted into the through-passing region of the rotating body and the other side formed with saw teeth, and a plurality of rotating bodies provided on the linking parts rotate by tooth-engagement between the rotating bolts;

wherein the linking part is supported and positioned between the pole parts by springs; and wherein the alarm parts are formed as a piezoelectric device and generate an electrical signal when the linking parts are pressurized so as to allow the alarm signal to be output from a speaker or a light bar.

2. The suicide-preventing fence of claim 1, wherein a fitting groove is formed in the center of the rotating body along the outer circumferential surface and the suicide-preventing fence further comprises rotating ropes, each of which is connected to the fitting grooves of vertically arranged rotating bodies among the plurality of rotating bodies provided on different linking parts.

3. The suicide-preventing fence of claim 1, further comprising:

rotating blades provided at predetermined intervals along the outer circumferential surfaces of the rotating bodies; and power generating parts configured to generate electricity as the rotating blades rotate.

* * * * *